US011510503B2

(12) United States Patent
Pacella et al.

(10) Patent No.: US 11,510,503 B2
(45) Date of Patent: Nov. 29, 2022

(54) PLAY YARD WITH REMOVABLE SOFT GOODS

(71) Applicant: Wonderland Switzerland AG, Steinhausen (CH)

(72) Inventors: Jonathan M. Pacella, Coatesville, PA (US); Jonathan K. Mountz, Birdsboro, PA (US); Jerry S. Ingraham, Denver, PA (US); Nathanael Saint, Morgantown, PA (US); Patrick J. G. Bowers, Hockessin, DE (US)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

(21) Appl. No.: 16/403,643

(22) Filed: May 6, 2019

(65) Prior Publication Data

US 2019/0335919 A1 Nov. 7, 2019

Related U.S. Application Data

(60) Provisional application No. 62/701,082, filed on Jul. 20, 2018, provisional application No. 62/667,789, filed on May 7, 2018.

(51) Int. Cl.
*A47D 13/06* (2006.01)

(52) U.S. Cl.
CPC ..... *A47D 13/066* (2013.01)

(58) Field of Classification Search
CPC .... A47D 13/066; A47D 13/06; A47D 13/061; A47D 13/063; A47D 13/065; A47D 13/068
See application file for complete search history.

(56) References Cited

U.S. PATENT DOCUMENTS

| | | | | |
|---|---|---|---|---|
| 6,575,435 | B1 * | 6/2003 | Kotzen | E04H 4/06 256/25 |
| 8,635,721 | B2 * | 1/2014 | Zhang | A47D 13/063 5/98.1 |
| 9,301,624 | B2 * | 4/2016 | Rosenthal | A47D 13/063 |
| 2005/0262629 | A1 * | 12/2005 | Cheng | A47D 13/063 5/98.1 |
| 2006/0185082 | A1 * | 8/2006 | Casati Troutman | A47D 13/063 5/99.1 |
| 2011/0140061 | A1 * | 6/2011 | Cheng | A47D 13/061 256/25 |
| 2012/0012801 | A1 * | 1/2012 | Burns | A47D 13/06 256/25 |
| 2012/0216346 | A1 * | 8/2012 | Rampton | A47D 13/061 256/25 |

(Continued)

*Primary Examiner* — Peter M. Cuomo
*Assistant Examiner* — George Sun
(74) *Attorney, Agent, or Firm* — Volpe Koenig

(57) ABSTRACT

A play yard includes a plurality of corner posts, a plurality of rails, a floor structure and at least one soft good assembly. Each of the plurality of corner posts includes a first guiding component. Each of the plurality of rails is connected between two adjacent corner posts. The floor structure is connected to the plurality of corner posts. The soft good assembly includes soft goods, a soft goods connector and a second guiding component. The soft goods connector is fixed to the soft goods. The second guiding component is connected to the soft goods connector and adapted to be detachably assembled with the corner post via the first guiding component for tensioning the soft goods.

16 Claims, 17 Drawing Sheets

(56) References Cited

U.S. PATENT DOCUMENTS

| | | | | |
|---|---|---|---|---|
| 2013/0133136 | A1* | 5/2013 | Cheng | A47D 7/00 5/282.1 |
| 2015/0001455 | A1* | 1/2015 | Chen | A47D 13/066 256/65.01 |
| 2016/0183698 | A1* | 6/2016 | Szymanski | A47D 13/066 5/99.1 |
| 2016/0242566 | A1* | 8/2016 | Tadipatri | A47D 13/066 |
| 2017/0312644 | A1* | 11/2017 | Meir | E04H 4/0056 |

* cited by examiner

PLAY YARD WITH REMOVABLE SOFT GOODS

CROSS REFERENCE TO RELATED APPLICATIONS

This application claims the benefit of U.S. provisional application No. 62/667,789 (which was filed on May 7, 2018), and U.S. provisional application No. 62/701,082 (which was filed on Jul. 20, 2018). The disclosures of the prior applications are incorporated herein by reference herein in their entirety.

BACKGROUND OF THE INVENTION

1. Field of the Invention

The present invention relates to a play yard, and more particularly, to a play yard with removable soft goods.

2. Description of the Prior Art

A conventional play yard is typically constructed with soft goods permanently attached to a rigid frame. The soft goods cannot be removed from the rigid frame without damaging either the soft goods or the frame components of the rigid frame. The soft goods affixed to the rigid frame naturally become dirty over time from spills, food, dirt and occasional overflowing diaper. With the frame components intact, it is difficult and time consuming to thoroughly wash and clean the soft goods.

SUMMARY OF THE INVENTION

The present invention provides a play yard with removable soft goods for solving above drawbacks.

According to the claimed invention, a play yard includes a plurality of corner posts, a plurality of rails, a floor structure and at least one soft good assembly. Each of the plurality of corner posts includes a first guiding component. Each of the plurality of rails is connected between two adjacent corner posts. The floor structure is connected to the plurality of corner posts. The soft good assembly includes soft goods, a soft goods connector and a second guiding component. The soft goods connector is fixed to the soft goods. The second guiding component is connected to the soft goods connector and adapted to be detachably assembled with the corner post via the first guiding component for tensioning the soft goods.

According to the claimed invention, the at least one soft good assembly further includes a constraining clip adapted to engage with the corner post for constraining a removal of the soft goods connector or the second guiding component.

According to the claimed invention, the first guiding component is a slot formed on a lateral side of the corner post, and the second guiding component is an external track connected to the soft goods connector in a loose fit manner and detachably engaged with the slot. The second guiding component includes a first rounded edge and a second rounded edge opposite to each other. The first rounded edge is affixed to the soft goods connector, and the second rounded edge is detachably engaged inside the first guiding component.

According to the claimed invention, the first guiding component is an external track formed on a lateral side of the corner post, and the second guiding component is a slot formed on the soft goods connector and detachably engaged with the external track. The first guiding component includes two rounded edges adapted to abut against an inner surface of the second guiding component for engagement.

According to the claimed invention, each corner post includes an edge corner having a through hole structure. The at least one soft good assembly further includes a tensioning component connected to the soft goods and adapted to detachably pierce through the through hole structure for tensioning the soft goods. The tensioning component pierces through the through hole structure from an inner side to an outer side of the edge corner, and abuts against an outer surface of the edge corner. The tensioning component is in a first rotary position to insert into the through hole structure, and then rotated from the first rotary position to a second rotary position for covering the through hole structure.

According to the claimed invention, the soft goods connector includes a flat edge whereon the soft goods are disposed. The second guiding component is wrapped by the soft goods. An edge of the soft goods is rounded to form the soft goods connector as a tunnel, and the second guiding component is a rod adapted to sewn into the tunnel. The soft goods include a restraining component and a textile element connected to each other. Each of the plurality of rails is wrapped around by the textile element. and the textile element is sealed via the restraining component.

According to the claimed invention, the first guiding component is a slot. The slot includes a narrow section and a wide section connected to each other. A width of the narrow section is larger than a thickness of the second guiding component, and a width of the wide section is wider than the width of the narrow section to allow insertion of the second guiding component or insertion of the soft goods and the second guiding component. The corner post further includes an inclined portion disposed near the wide section of the slot and adapted to guide a movement of the soft goods connector or the second guiding component.

According to the claimed invention, the wide section is located on an upper end of the slot, and the soft goods include a positioning component adapted to attach to the corner post. The corner post has a first jointing component, and the positioning component has a second jointing component adapted to connect with the first jointing component for tensioning the soft goods. The first jointing component is an attachment boss disposed on a lower end of the corner post, and the second jointing component is an opening structure for sheathing the attachment boss. Further, the wide section can be located on a lower end of the slot.

The play yard of the present invention can design the slot with the narrow section and the wide section on the corner post, so the soft good assembly can conveniently insert into the wide section and be pulled through the narrow section to be movably located inside the slot of the corner post. The wide section of the slot can be set on the upper end or the lower end of the corner post, and then the positioning component and the first and second jointing components can be designed accordingly. The soft goods connector and the second guiding component of the soft good assembly can respectively be the rod and the soft good tunnel, or the stiffener and the external track. The soft goods can be disassembled from the corner posts by unzipping the restraining component, unwrapping the textile element from the rails, and removing the soft good assembly from the corner post, so that the play yard of the present invention has an advantage of the removable soft goods.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
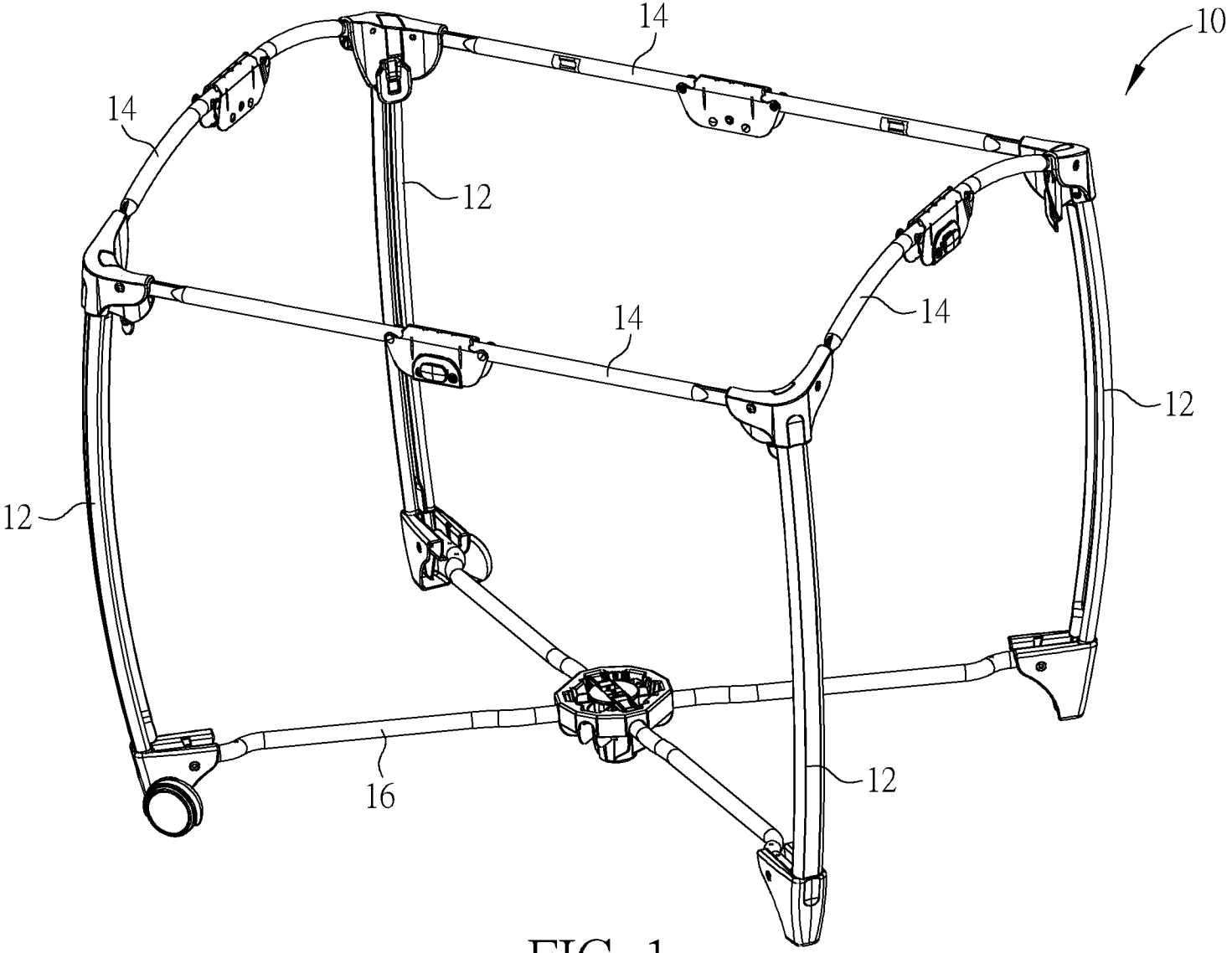
FIG. 1 is a diagram of a play yard according to an embodiment of the present invention.
Figure 2:
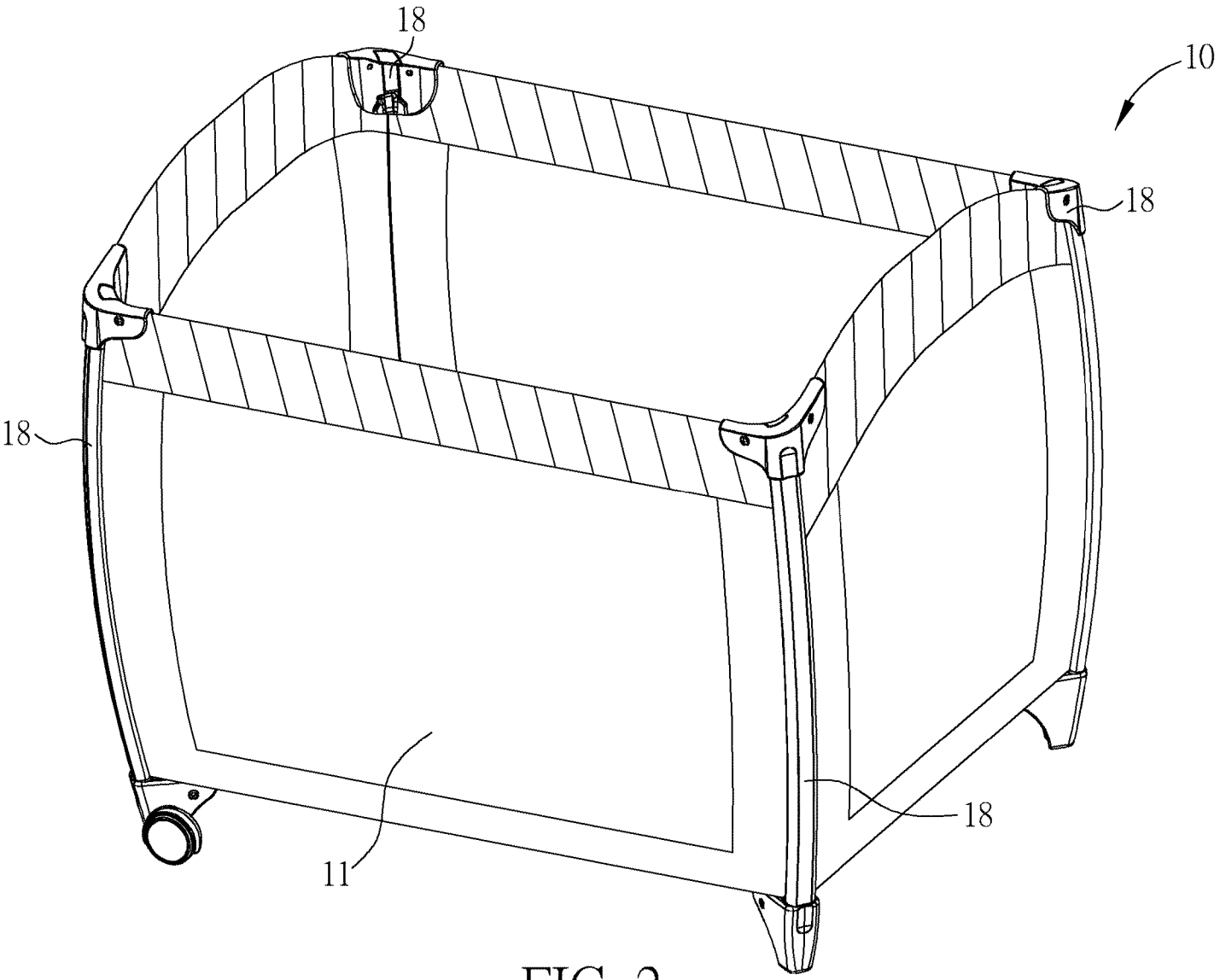
FIG. 2 is a diagram of the play yard with soft goods according to the embodiment of the present invention.

Please refer to FIG. 1 and FIG. 2. FIG. 1 is a diagram of a play yard 10 according to an embodiment of the present invention. FIG. 2 is a diagram of the play yard 10 with soft goods 11 according to the embodiment of the present invention. The play yard 10 can include a plurality of corner posts 12, a plurality of rails 14, a floor structure 16 and at least one soft good assembly 18. Each of the rails 14 can be connected between upper ends of two adjacent corner posts 12, and the floor structure 16 can be connected to bottom ends of the corner posts 12 for forming a play yard frame. The play yard frame is covered by the soft goods 11 via the soft good assembly 18, so that a child can stay in the play yard 10 safely.

Figure 3:
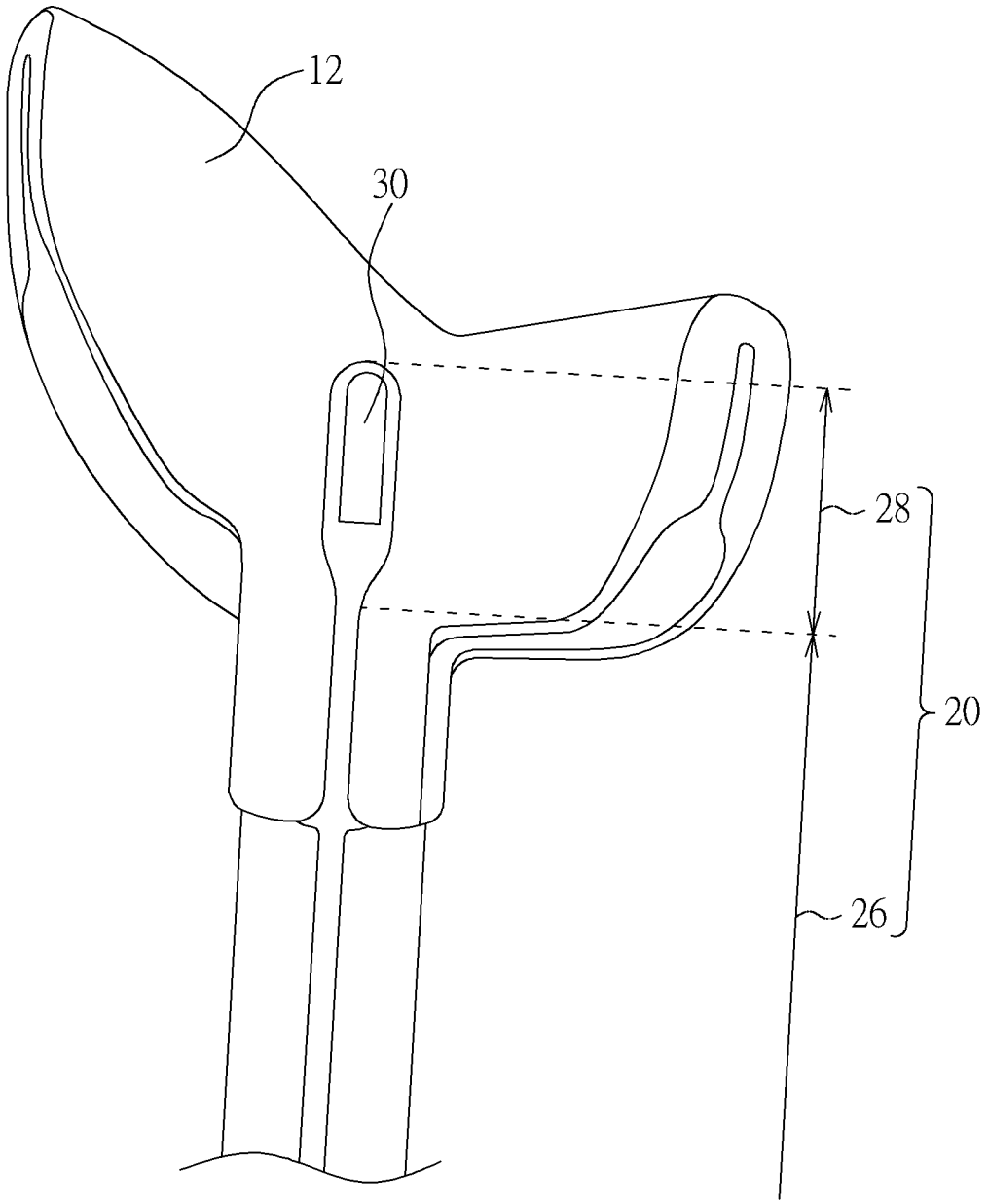
FIG. 3 is a diagram of a corner post according to the embodiment of the present invention.
Figure 4:
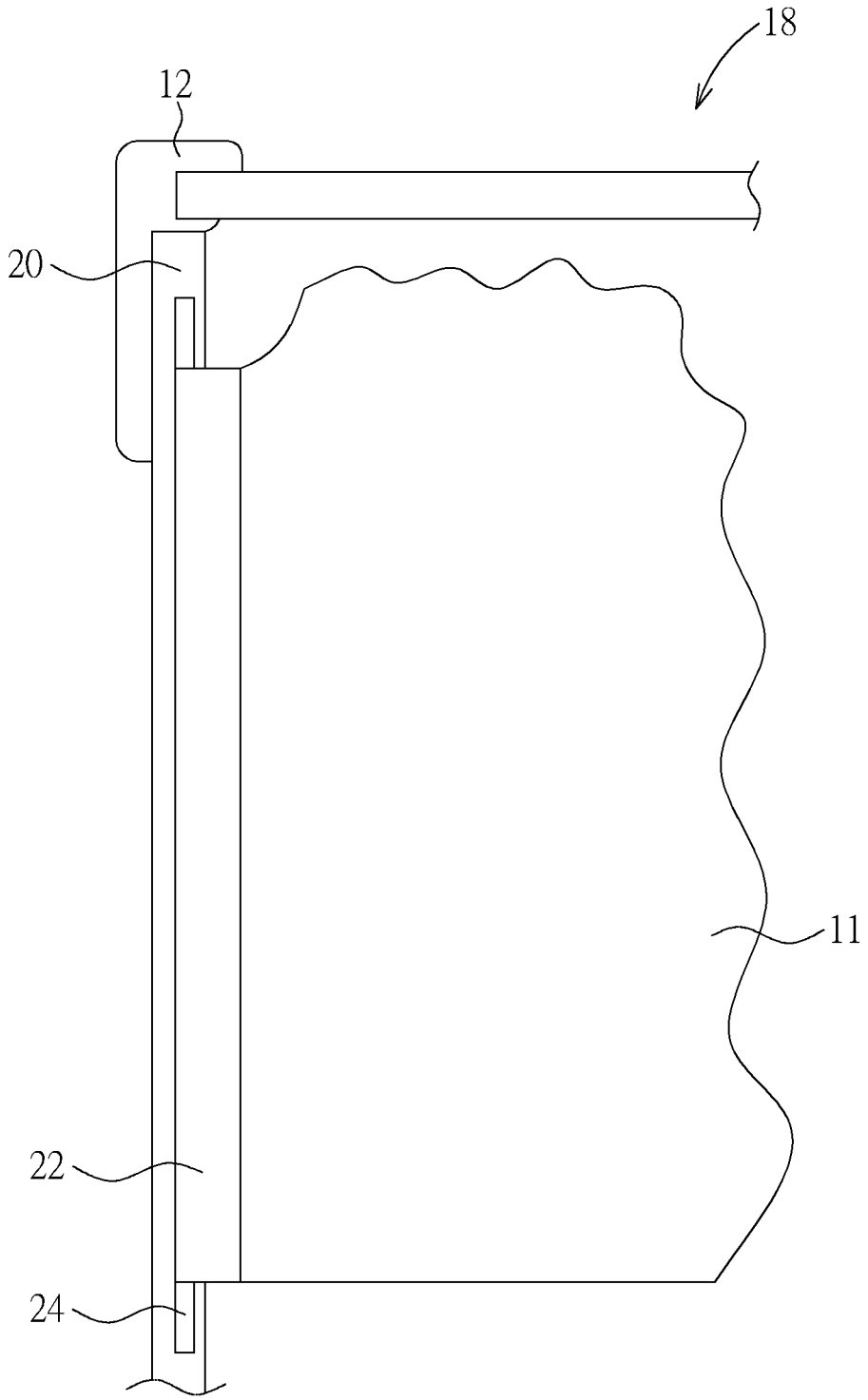
FIG. 4 and FIG. 5 are diagrams of a soft good assembly in different views according to a first embodiment of the present invention.
Figure 5:
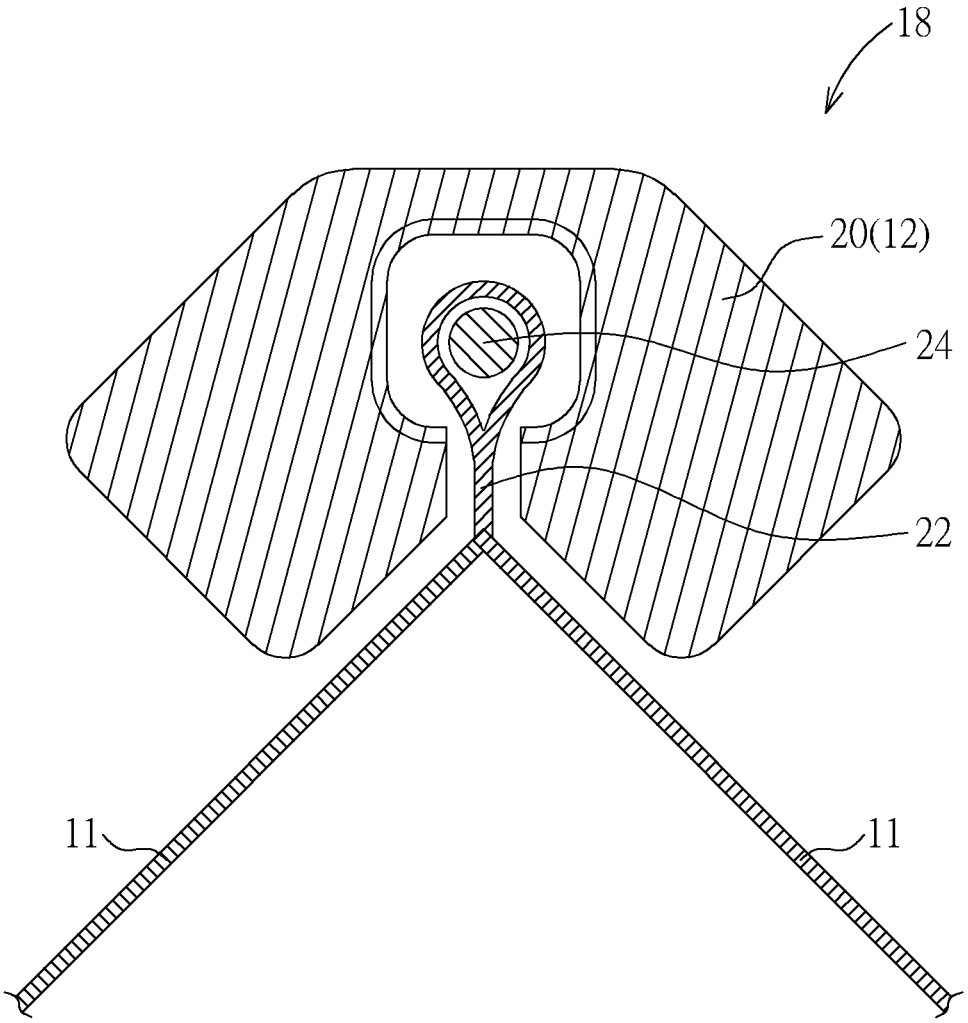

Please refer to FIG. 3 to FIG. 5. FIG. 3 is a diagram of the corner post 12 according to the embodiment of the present invention. FIG. 4 and FIG. 5 are diagrams of the soft good assembly 18 indifferent views according to a first embodiment of the present invention. Each of the corner posts 12 can include a first guiding component 20. The soft good assembly 18 can include a soft good connector 22 and a second guiding component 24. The first guiding component 20 can be a slot formed on a lateral side of the corner post 12. The foresaid slot can include a narrow section 26 and a wide section 28 connected to each other. The soft good connector 22 can be fixed to the soft goods 11. The second guiding component 24 can be connected to the soft good connector 22. The second guiding component 24 can be a resilient rod used to be detachably installed inside the first guiding component 20 of the corner post 12.

It should be mentioned that an edge of the soft goods 11 can be rounded to form the soft good connector 22 as a tunnel, which means the second guiding component 24 can be wrapped by the soft goods 11; or, an extra structural component having a through hole can be represented as the soft good connector 22. The second guiding component 24 designed as the resilient rod can sew into the soft good connector 22, and the soft good connector 22 with the second guiding component 24 can be inserted into the first guiding component 20 in a movable and detachable manner.

In the first embodiment, an inner width of the narrow section 26 can be larger than a thickness of the second guiding component 24 covered by the soft good connector 22 or the soft goods 11, and an opening width of the narrow section 26 can be smaller than the foresaid thickness. Thus, the soft good assembly 18 can be moved inside the corner post 12 along a structurally vertical direction of the first guiding component 20, and cannot be separated from the corner post 12 via a lateral opening of the first guiding component 20. In addition, a width of the wide section 28 can be wider than the width of the narrow section 26, so as to allow insertion of the second guiding component 24, or insertion of the soft goods 11 and the second guiding component 24. The soft good assembly 18 can insert into the first guiding component 20 easily due to the wide section 28.

Figure 6:
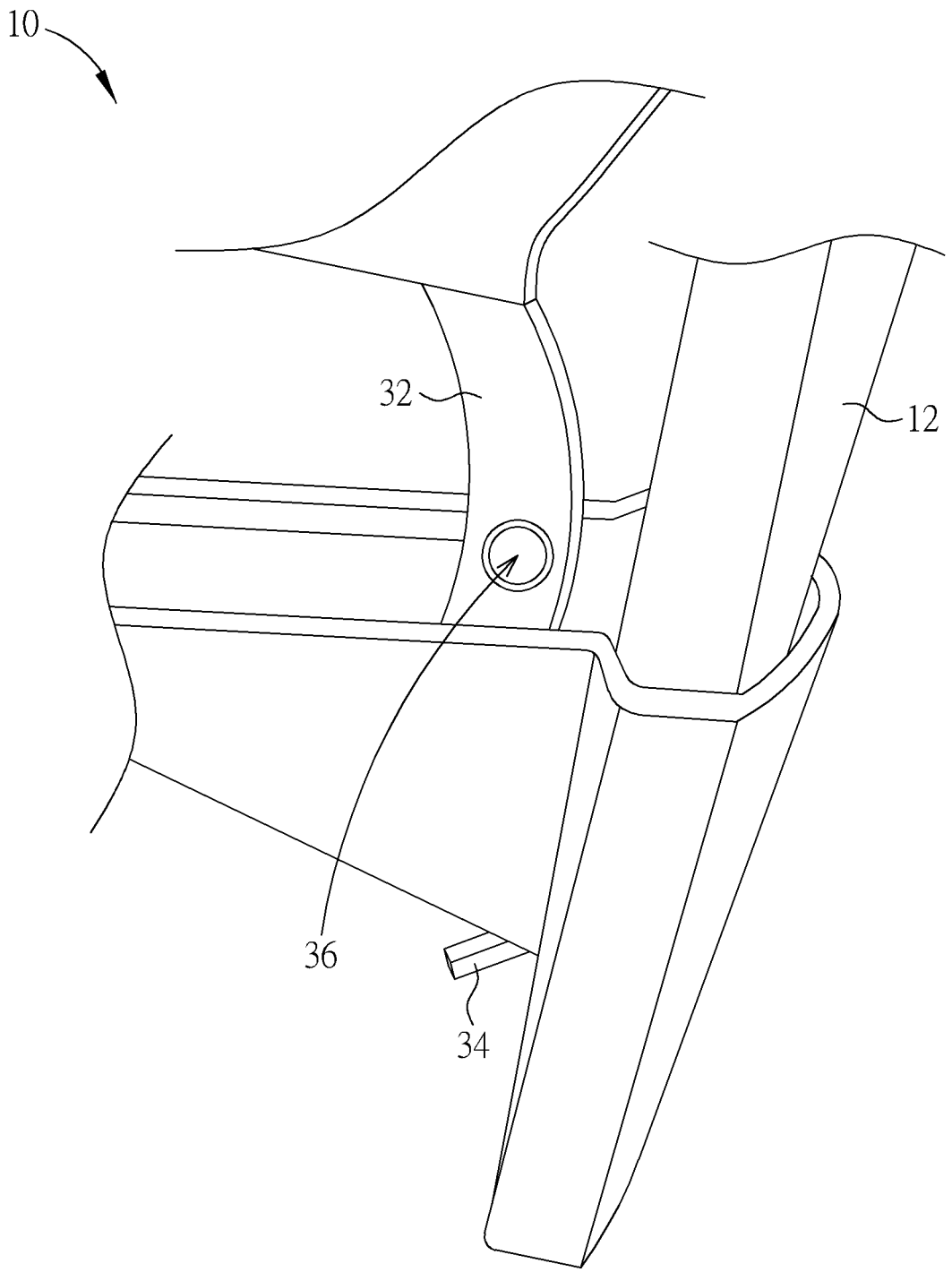
FIG. 6 to FIG. 8 are diagrams of a part of the play yard according to the first embodiment of the present invention.
Figure 7:
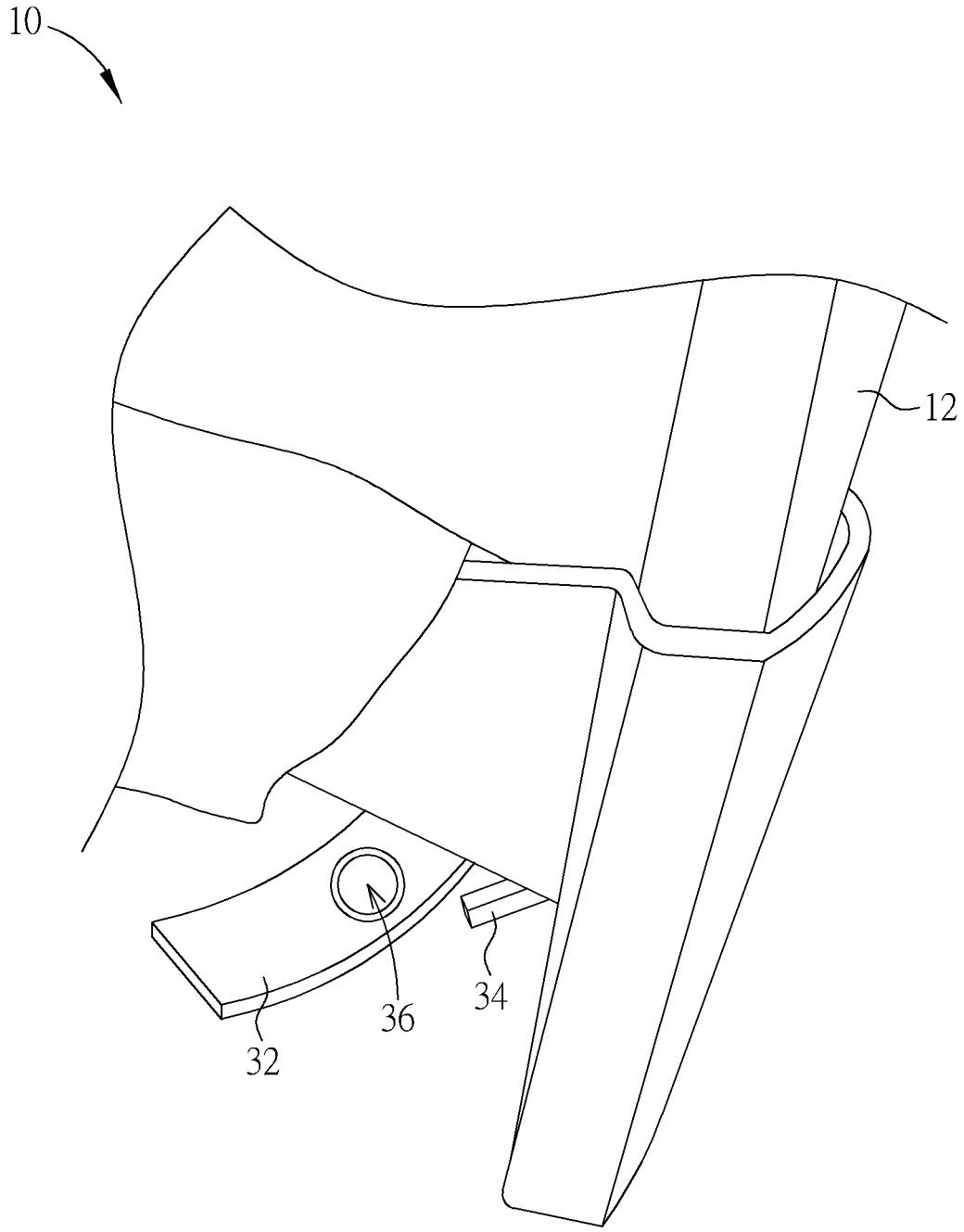
Figure 8:
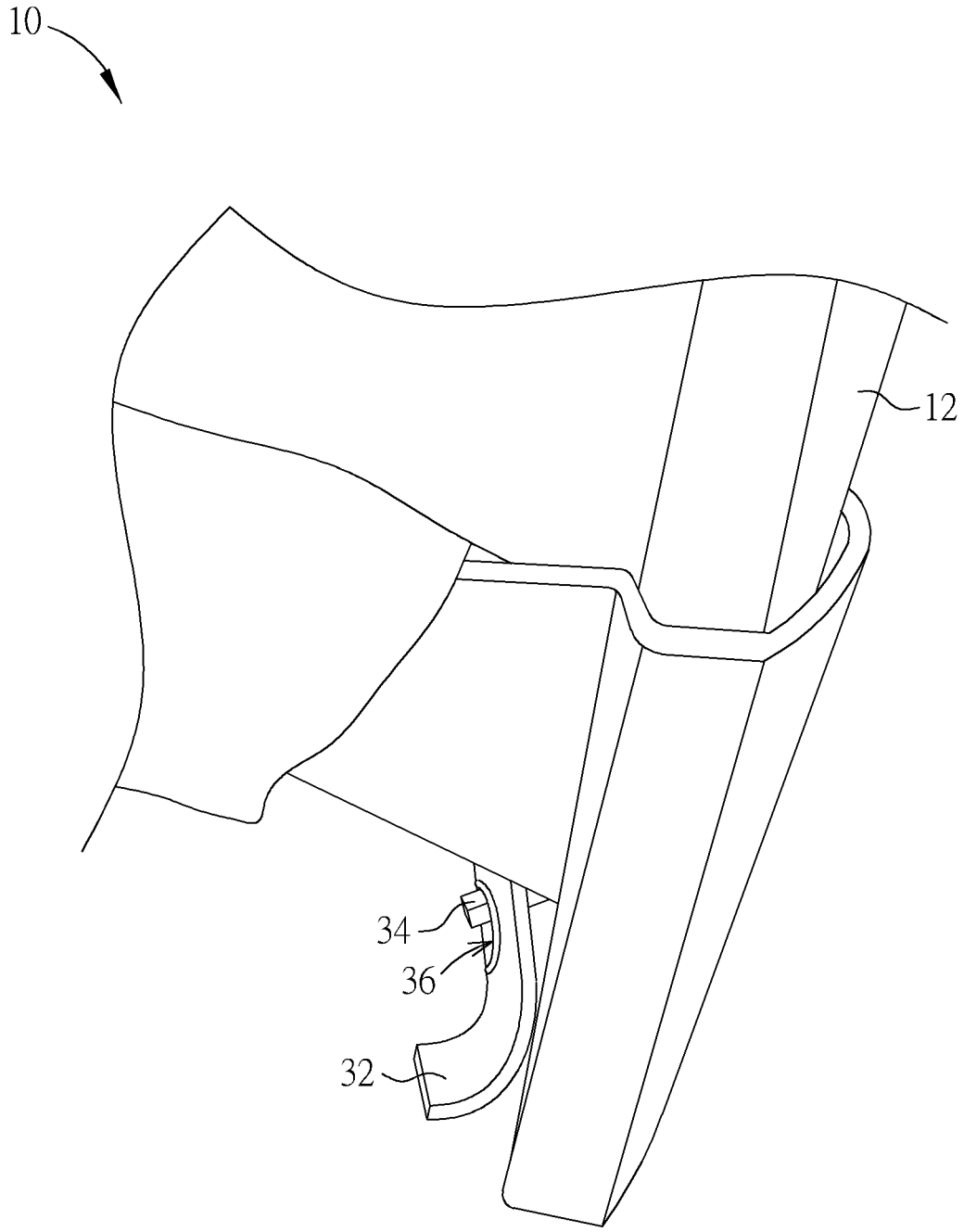

Moreover, the corner post 12 can further include an inclined portion 30. The inclined portion 30 can be disposed on a lateral surface of the corner post 12 and adjacent to a position near the wide section 28 of the first guiding component 20, and can be inclined toward a center of the corner post 12 via an inclined angle. The inclined portion 30 can be used to guide a movement of at least one of the soft goods connector 22 and the second guiding component 24. A connection about the inclined portion 30 and the first guiding component 20 can be lower than an upper surface of the corner post 12; besides, the narrow section 26 and the wide section 28 of the first guiding component 20 can be sheltered by the corner post 12. The said movement can be a removal or an assembly of the soft goods connector 22 and the second guiding component 24. Please refer to FIG. 6 to FIG. 8. FIG. 6 to FIG. 8 are diagrams of a part of the play yard 10 according to the first embodiment of the present invention. The wide section 28 can be located on an upper end of the first guiding component 20, and accordingly the soft goods 11 may include a positioning component 32 disposed on a lower edge of the soft goods 11. The corner post 12 can have a first jointing component 34, such as an attachment boss; and the positioning component 32 can have a second jointing component 36, such as an opening structure. The attachment boss can be sheathed by the opening structure for tensioning the soft goods 11 and then attaching the soft goods 11 to the corner post 12.

The attachment boss (which means the first jointing component 34) can be disposed on a lower end of the corner post 12 because the soft good assembly 18 is assembled with the corner post 12 via an upper end of the corner post 12. In another possible situation, the first jointing component 34 may be the opening structure, and the second jointing component 36 may be the attachment boss. Structural design of the first jointing component 34 and the second jointing component 36 are not limited to the above-mentioned embodiments, which depends on design demand.

Figure 9:
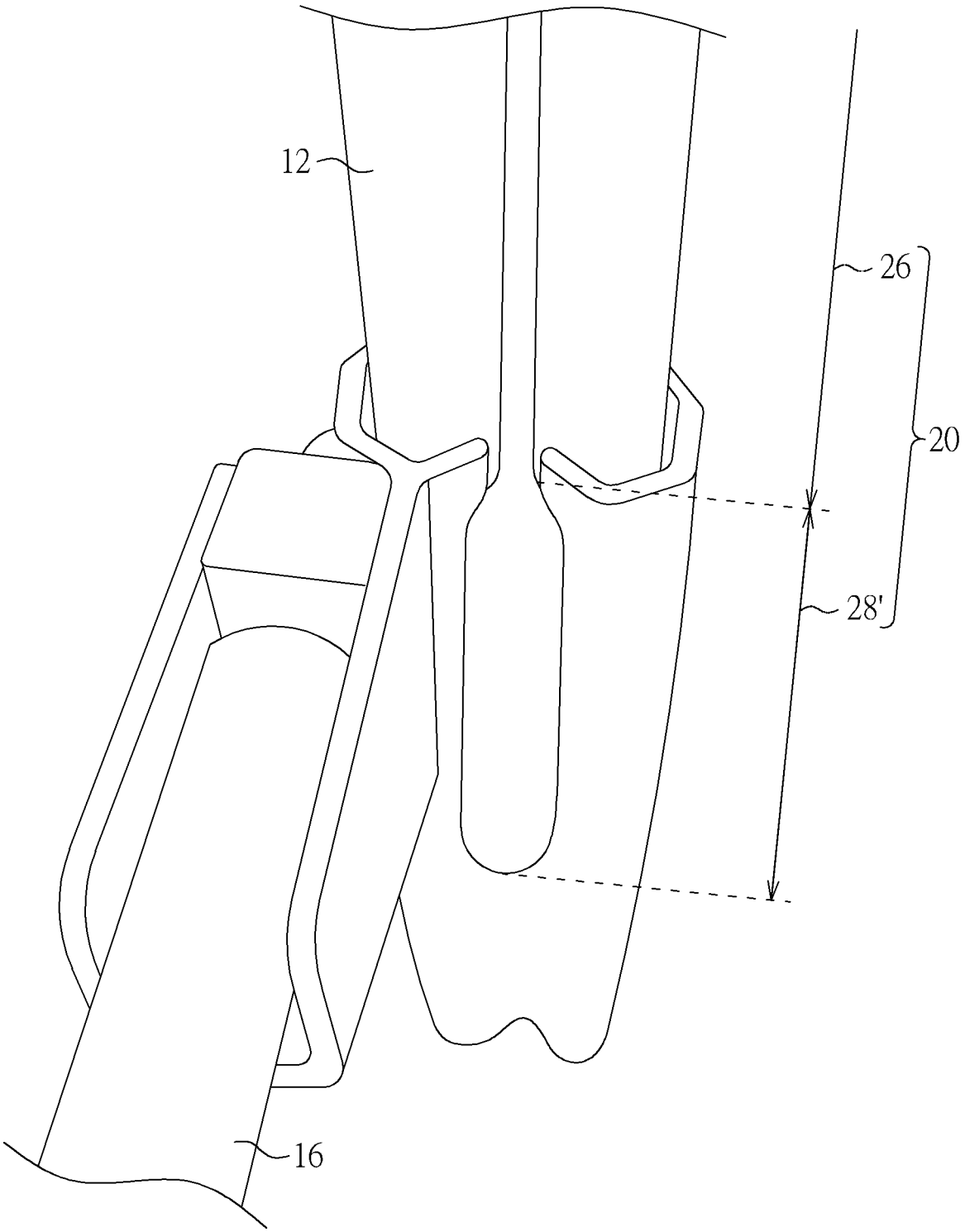
FIG. 9 and FIG. 10 are diagrams of the soft good assembly in different views according to a second embodiment of the present invention.
Figure 10:
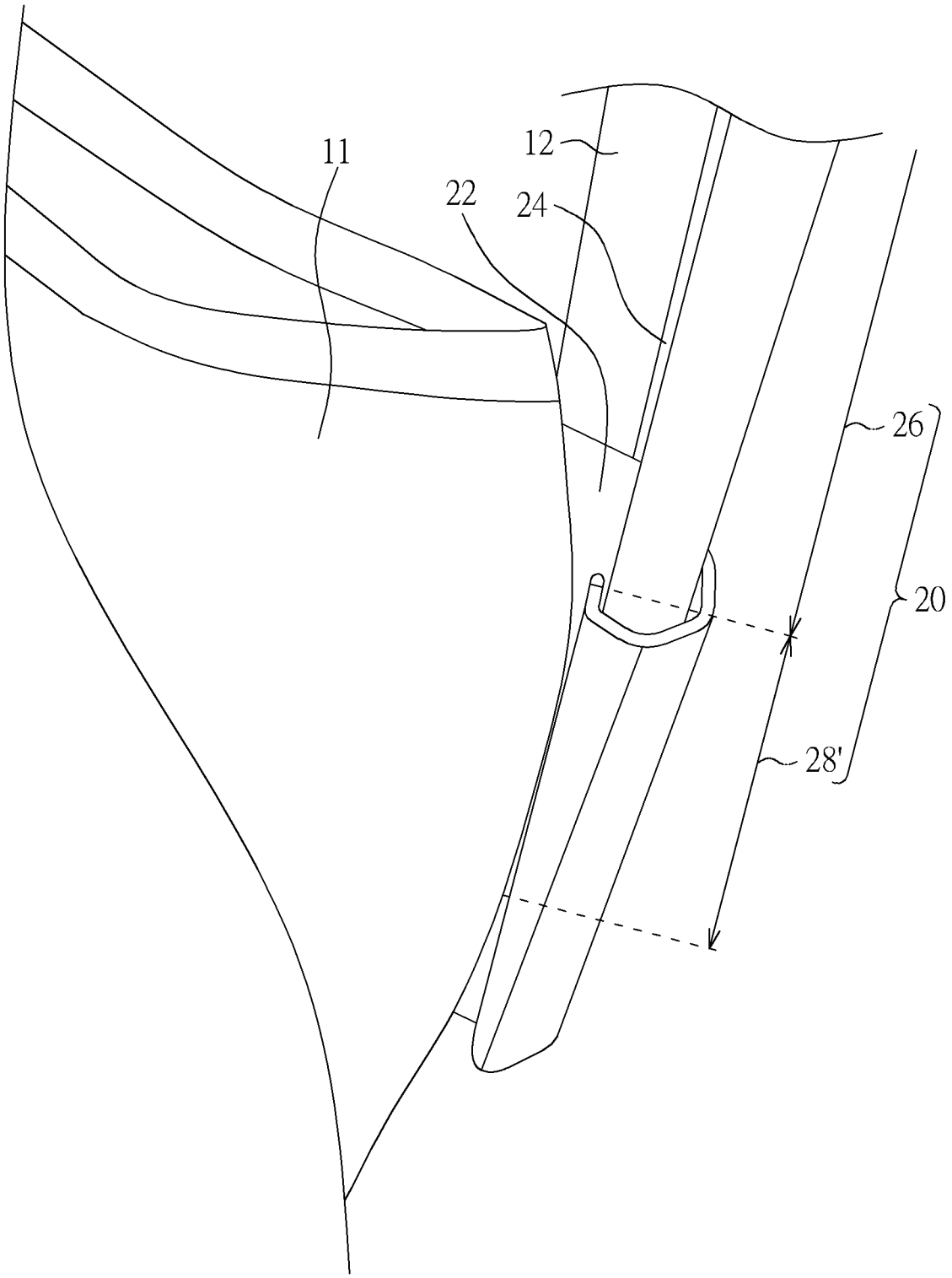

Please refer to FIG. 9 and FIG. 10. FIG. 9 and FIG. 10 are diagrams of the soft good assembly 18 in different views according to a second embodiment of the present invention. In the second embodiment, elements having the same numerals have the same structures and functions as ones of the first embodiment, and a detailed description is omitted herein for simplicity. The soft good assembly 18 in the second embodiment can design the wide section 28' located on a lower end of the first guiding component 20. The second guiding component 24 connected to the soft good connector 22 can insert into the lower end of the first guiding component 20 via the wide section 28', and then the second guiding component 24 can be pulled through the narrow section 26 upwardly along a length of the first guiding component 20 for tensioning the soft goods 11 and then attaching the soft goods 11 to the corner post 12.

In the second embodiment, the wide section 28' can be disposed on the lower end of the first guiding component 20, and the soft goods 11 can be assembled with the corner post 12 through its lower end, so that the soft goods 11 may not have the positioning component, and the corner post 12 may not have the first jointing component.

Figure 11:
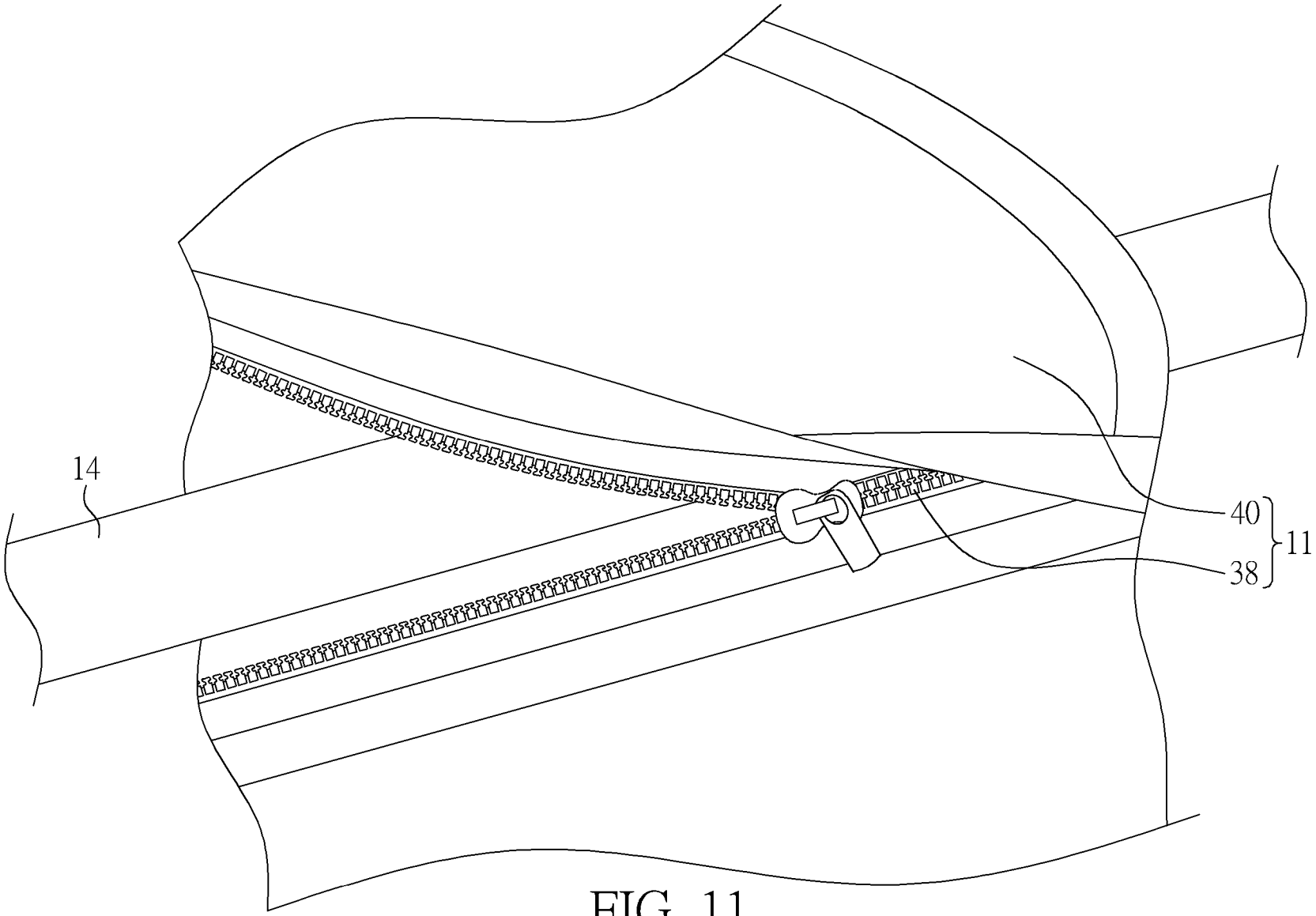
FIG. 11 is a diagram of the soft goods according to the embodiment of the present invention.

Please refer to FIG. 11. FIG. 11 is a diagram of the soft goods 11 according to the embodiment of the present invention. The soft goods 11 can have a restraining component 38 and a textile element 40 connected to each other. The rail 14 can be wrapped around by the textile element 40, which means the wrapped textile element 40 can form a soft goods top rail tunnel, and the textile element 40 can be sealed via the restraining component 38, for affixing the soft goods 11 to the plurality of rails 14.

Figure 12:
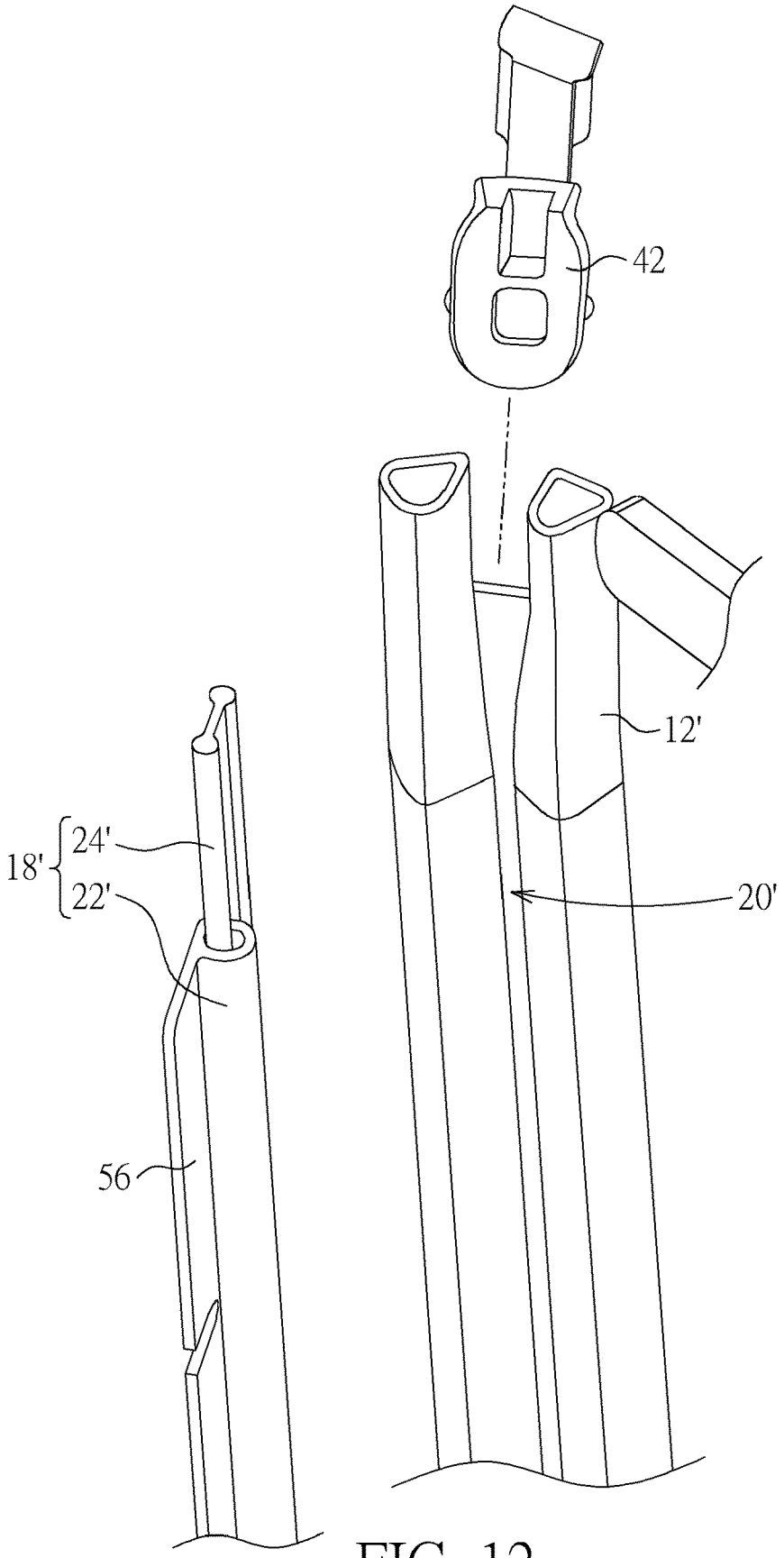
FIG. 12 is a diagram of the soft good assembly disassembled from the corner post according to a second embodiment of the present invention.
Figure 13:
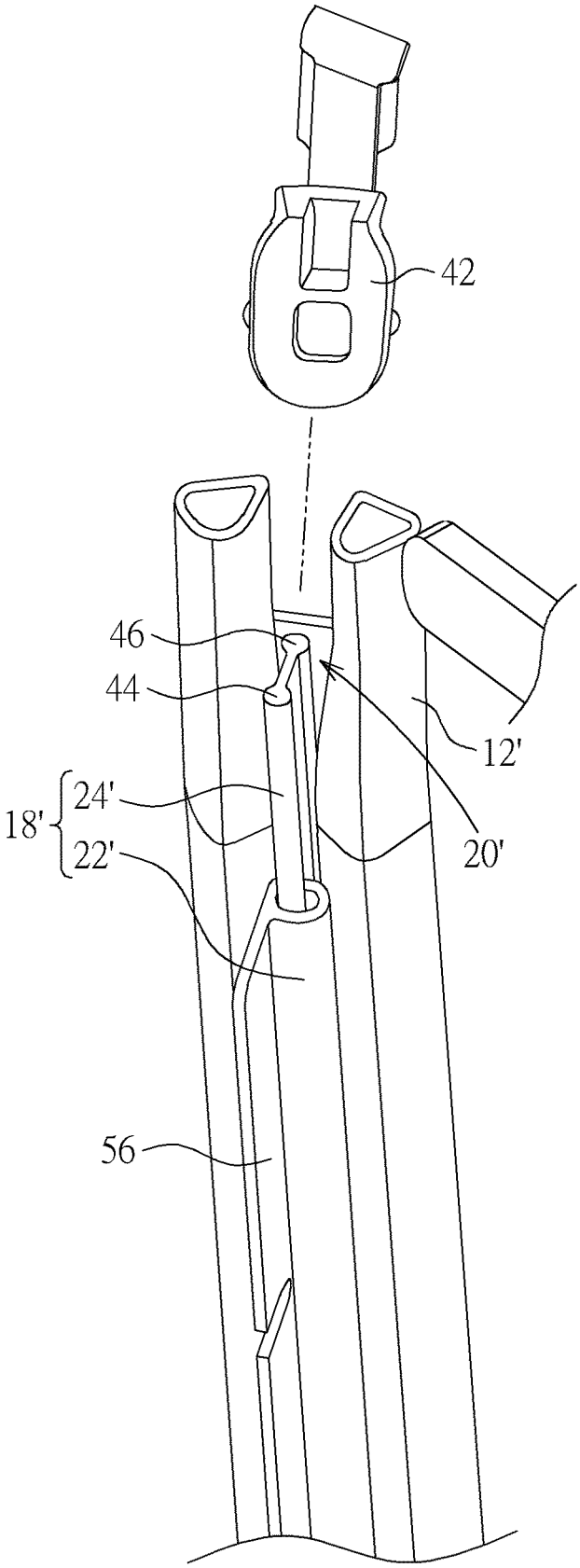
FIG. 13 is a diagram of the soft good assembly assembled with the corner post according to the second embodiment of the present invention.

Please refer to FIG. 12 and FIG. 13. FIG. 12 is a diagram of the soft good assembly 18' disassembled from the corner post 12' according to a second embodiment of the present invention. FIG. 13 is a diagram of the soft good assembly 18' assembled with the corner post 12 according to the second embodiment of the present invention. The corner post 12' can include the first guiding component 20'. The soft good assembly 18' can include the soft good connector 22', the second guiding component 24' and a constraining clip 42. The constraining clip 42 can be used to engage with an upper end of the corner post 12' for constraining a removal of the soft goods connector 22' and/or the second guiding component 24'.

The first guiding component 20' may have the wide section and the narrow section, and the wide section can be located on the upper end of the first guiding component 20'. The second guiding component 24' can be an external track connected to the soft goods connector 22' in a loose fit manner and detachably engaged with the first guiding component 20'. The soft goods connector 22' can be connected to the soft goods 11, which is not shown in FIGS. 12-13. The second guiding component 24' designed as the external track can include a first rounded edge 44 and a second rounded edge 46 opposite to each other. The first rounded edge 44 can be affixed to the soft goods connector 22', and the second rounded edge 46 can be detachably engaged inside the first guiding component 20', so that the soft goods connector 22' can be assembled with the corner post 12' via the second guiding component 24'.

Besides, the soft goods connector 22' can include a flat edge 56 whereon the soft goods 11 can be disposed. The flat edge 56 can be a stretching portion extending from a tube (whereinto the first guiding component 20' inserts) for providing as a platform. The soft goods 11 can be disposed on the foresaid platform via a screw, a bolt, a clip or adhesive.

Figure 14:
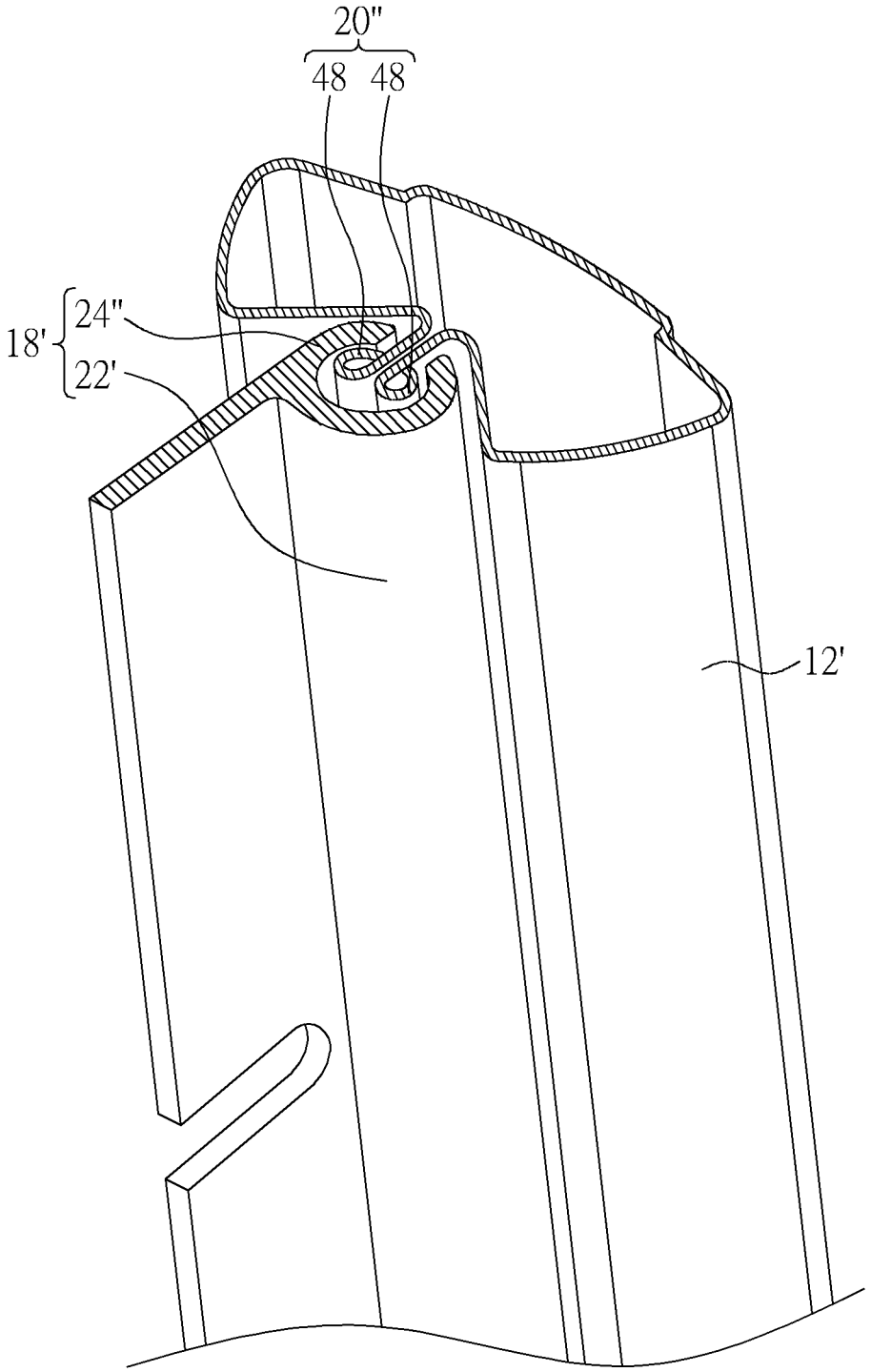
FIG. 14 is a diagram of the soft good assembly and the corner post according to another embodiment of the present invention.

Please refer to FIG. 14. FIG. 14 is a diagram of the soft good assembly 18' and the corner post 12' according to another embodiment of the present invention. The corner post 12' may have the first guiding component 20" designed as the external track. The first guiding component 20" can be formed on the lateral side of the corner post 12'. The soft good assembly 18' may include the second guiding component 24" designed as the slot, which can be formed on the soft goods connector 22' and detachably engaged with the first guiding component 20" (which means the external track). The first guiding component 20" can include two rounded edges 48 used to abut against an inner surface of the second guiding component 24", and thus the corner post 12' and the soft good assembly 18' can be assembled in a movable manner.

Figure 15:
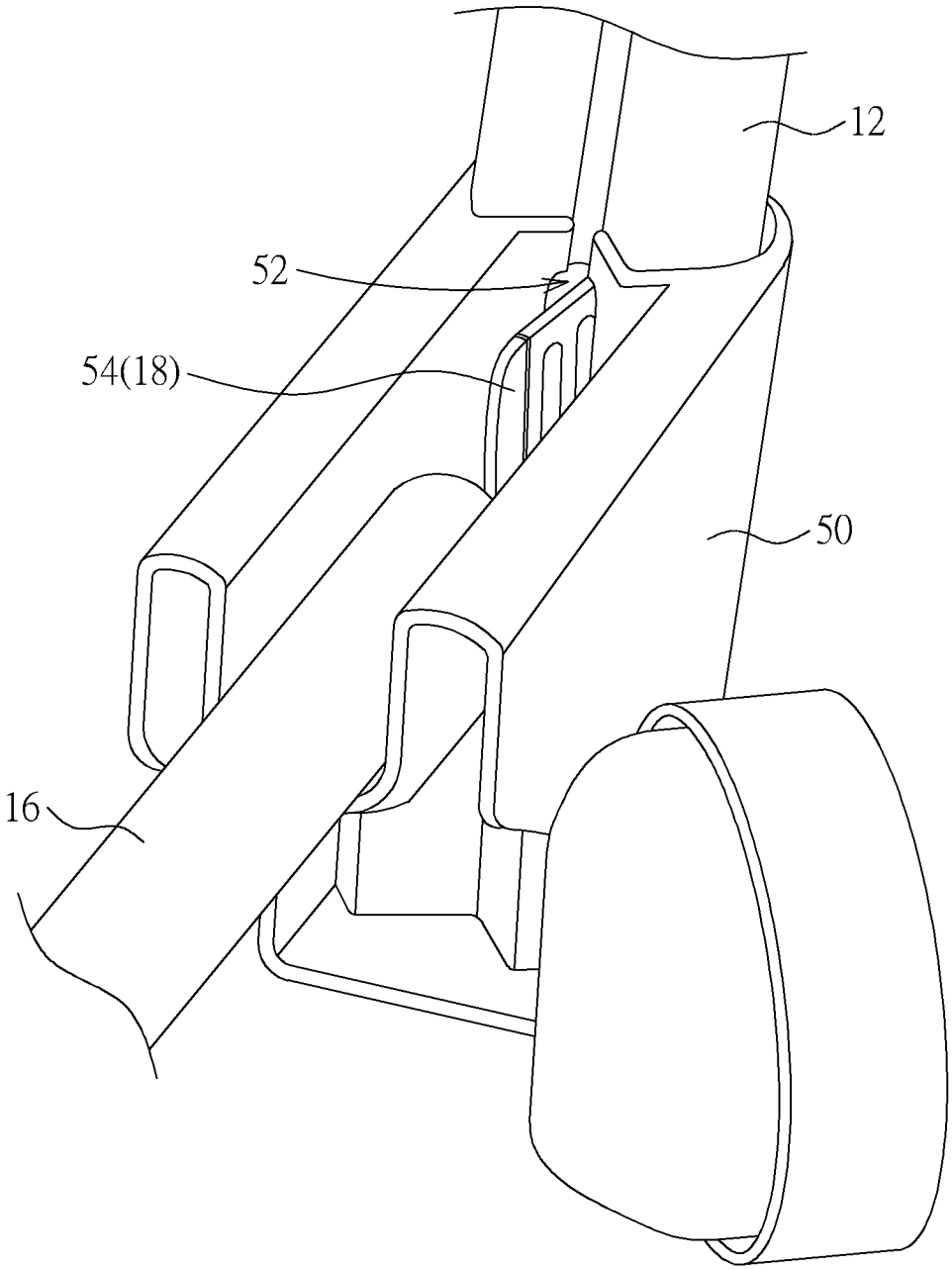
FIG. 15 to FIG. 17 respectively are diagrams of the corner post and the soft good assembly in different operation modes according to the embodiment of the present invention.
Figure 16:
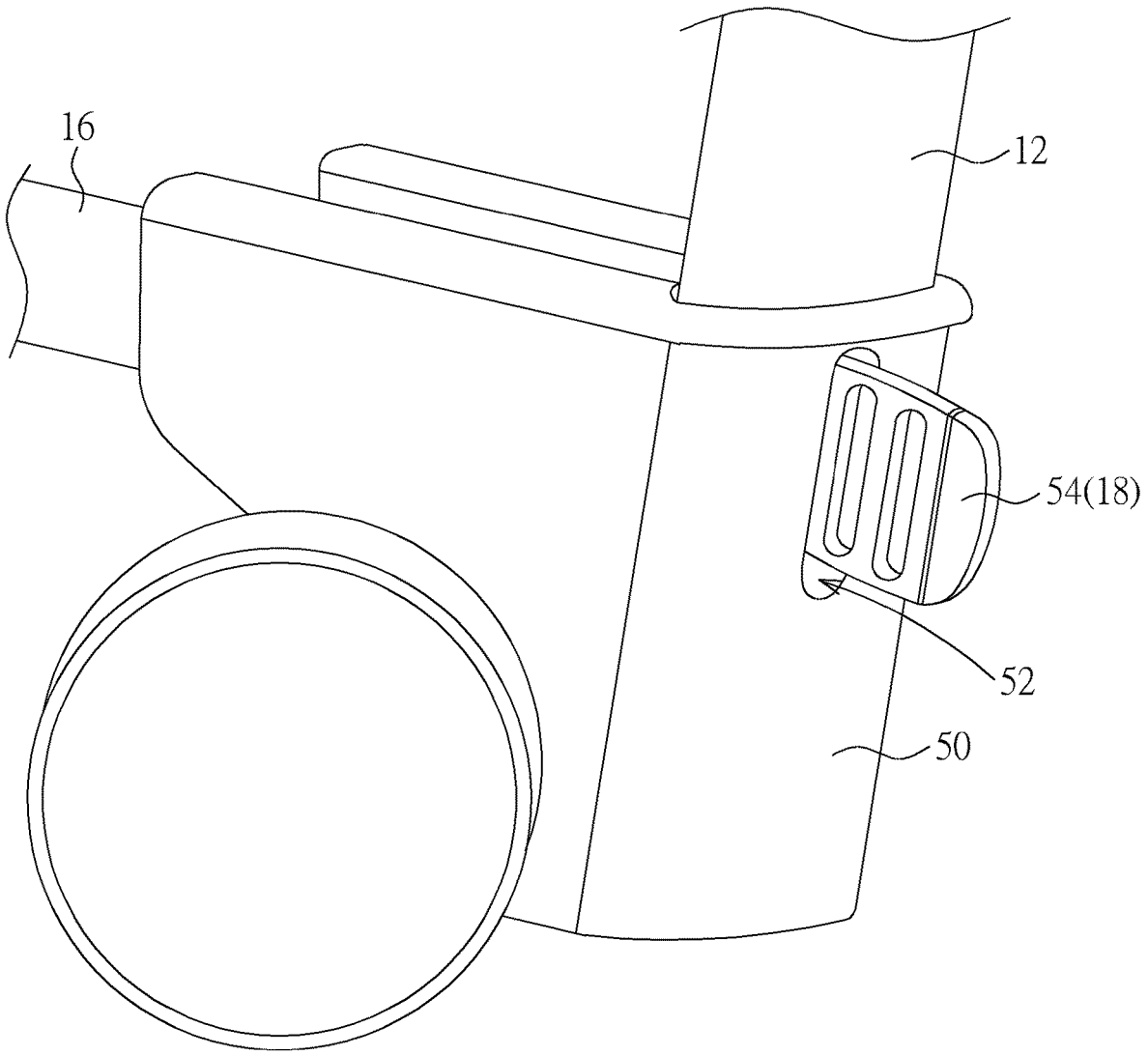
Figure 17:
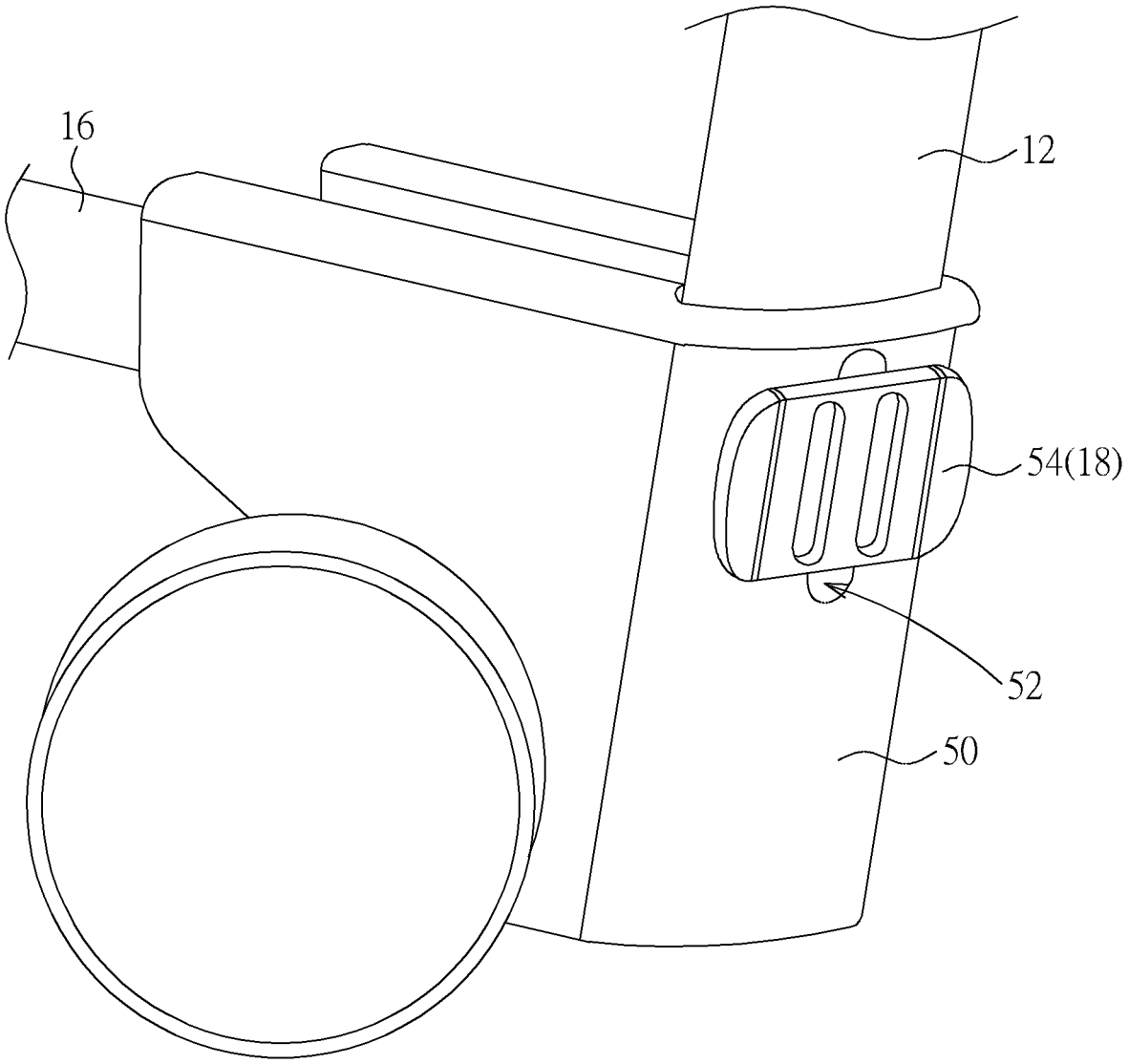

Please refer to FIG. 15 to FIG. 17. FIG. 15 to FIG. 17 respectively are diagrams of the corner post 12 and the soft good assembly 18 in different operation modes according to the embodiment of the present invention. The corner post 12 can include an edge corner 50 having a through hole structure 52. The soft good assembly 18 can include a tensioning component 54 used to connect with the soft goods 11 and detachably pierce through the through hole structure 52. As shown in FIG. 15, the tensioning component 54 can stay in a first rotary position, and pierce through the through hole structure 5 from an inner side to an outer side of the edge corner 50; as shown in FIG. 16, the tensioning component 54 can still stay in the first rotary position and exposed out of the through hole structure 52; then, as shown in FIG. 17, the tensioning component 54 can be rotated from the first rotary position to a second rotary position, so as to abut against an outer surface of the edge corner 50 and cover the through hole structure 52 for tensioning the soft goods 11.

In conclusion, the play yard of the present invention can design the slot with the narrow section and the wide section on the corner post, so the soft good assembly can conveniently insert into the wide section and be pulled through the narrow section to be movably located inside the slot of the corner post. The wide section of the slot can be set on the upper end or the lower end of the corner post, and then the positioning component and the first and second jointing components can be designed accordingly. The soft goods connector and the second guiding component of the soft good assembly can respectively be the rod and the soft good tunnel, or the stiffener and the external track. The soft goods can be disassembled from the corner posts by unzipping the restraining component, unwrapping the textile element from the rails, and removing the soft good assembly from the corner post, so that the play yard of the present invention has an advantage of the removable soft goods.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A play yard, comprising:

a plurality of corner posts, each corner post comprising a first guiding component and an edge corner having a through hole;

a plurality of rails, each rail being connected between two adjacent corner posts;

a floor structure connected to the plurality of corner posts;

at least one soft good assembly, comprising:

soft goods;

a soft goods connector fixed to the soft goods; and a second guiding component connected to the soft goods connector and adapted to be detachably assembled with the corner post via the first guiding component for tensioning the soft goods, and at least one tensioning component connected to the at least one soft good assembly and adapted to detachably pierce through the through hole for tensioning the soft goods;

the at least one tensioning component is configured to extend within the through hole from: (i) an inner side of the edge corner defined by at least one of the plurality of corner posts to (ii) an outer side of the edge corner defined by the at least one of the plurality of corner posts, such that the at least one tensioning component extends through the at least one of the plurality of corner posts and abuts the outer side of the edge corner.

2. The play yard of claim 1, wherein the at least one soft good assembly further comprises a constraining clip adapted to engage with the corner post for constraining a removal of the soft goods connector or the second guiding component.

3. The play yard of claim 1, wherein the first guiding component is a slot formed on a lateral side of the corner post, and the second guiding component is an external track connected to the soft goods connector in a loose fit manner and detachably engaged with the slot.

4. A play yard, comprising:

a plurality of corner posts, each corner post comprising a first guiding component;

a plurality of rails, each rail being connected between two adjacent corner posts;

a floor structure connected to the plurality of corner posts; and at least one soft good assembly, comprising:

soft goods;

a soft goods connector fixed to the soft goods; and a second guiding component connected to the soft goods connector and adapted to be detachably assembled with the corner post via the first guiding component for tensioning the soft goods, wherein the second guiding component comprises a first enlarged end and a second enlarged end that are arranged on opposite longitudinal ends of a base body having a width that is less than a width of the first enlarged end and less than a width of the second enlarged end, the first enlarged end is affixed to the soft goods connector, and the second enlarged end is detachably engaged inside the first guiding component, and wherein the first enlarged end, the second enlarged end, and the base body of the second guiding component are formed as a unitary component.

5. The play yard of claim 1, wherein the first guiding component is an external track formed on a lateral side of the corner post, and the second guiding component is a slot formed on the soft goods connector and detachably engaged with the external track.

6. The play yard of claim 5, wherein the first guiding component comprises two rounded edges adapted to abut against an inner surface of the second guiding component for engagement.

7. The play yard of claim 1, wherein the soft goods connector comprises a flat edge whereon the soft goods are disposed.

8. The play yard of claim 1, wherein the second guiding component is wrapped by the soft goods.

9. The play yard of claim 8, wherein an edge of the soft goods is rounded to form the soft goods connector as a tunnel, and the second guiding component is a rod adapted to sewn into the tunnel.

10. The play yard of claim 1, wherein the soft goods comprise a restraining component and a textile element connected to each other, each of the plurality of rails is wrapped around by the textile element and the textile element is sealed via the restraining component.

11. The play yard of claim 1, wherein the first guiding component is a slot, the slot comprises a narrow section and a wide section connected to each other, a width of the narrow section is larger than a thickness of the second guiding component, and a width of the wide section is wider than the width of the narrow section to allow insertion of the second guiding component or insertion of the soft goods and the second guiding component.

12. The play yard of claim 11, wherein the corner post further comprises an inclined portion disposed near the wide section of the slot and adapted to guide a movement of the soft goods connector or the second guiding component.

13. The play yard of claim 11, wherein the wide section is located on an upper end of the slot, and the soft goods comprises a positioning component adapted to attach to the corner post.

14. The play yard of claim 13, wherein the corner post has a first jointing component, and the positioning component has a second jointing component adapted to connect with the first jointing component for tensioning the soft goods.

15. The play yard of claim 11, wherein the wide section is located on a lower end of the slot.

16. The play yard of claim 1, wherein the at least one tensioning component is configured to be:

arranged in a first rotary position to insert the at least one tensioning component into the through hole from the inner side of the edge corner, and rotated from the first rotary position to a second rotary position to cover the through hole such that the at least one tensioning component abuts the outer side of the edge corner.

* * * * *